US011075442B2

(12) United States Patent
Wang et al.

(10) Patent No.: US 11,075,442 B2
(45) Date of Patent: Jul. 27, 2021

(54) BROADBAND SUB 6GHZ MASSIVE MIMO ANTENNAS FOR ELECTRONIC DEVICE

(71) Applicants: Dong Wang, Waterloo (CA); Enliang Wang, Waterloo (CA)

(72) Inventors: Dong Wang, Waterloo (CA); Enliang Wang, Waterloo (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 912 days.

(21) Appl. No.: 15/610,085

(22) Filed: May 31, 2017

(65) Prior Publication Data

US 2018/0351235 A1 Dec. 6, 2018

(51) Int. Cl.

| | |
|---|---|
| ***H01Q 1/24*** | (2006.01) |
| ***H01Q 21/30*** | (2006.01) |
| ***H01Q 9/42*** | (2006.01) |
| ***H01Q 21/28*** | (2006.01) |
| ***H01Q 21/24*** | (2006.01) |

(52) U.S. Cl.

CPC ..... *H01Q 1/243* (2013.01); *H01Q 9/42* (2013.01); *H01Q 21/24* (2013.01); *H01Q 21/28* (2013.01); *H01Q 21/30* (2013.01)

(58) Field of Classification Search

CPC . H01Q 1/243–244; H01Q 21/24; H01Q 21/30
See application file for complete search history.

(56) References Cited

U.S. PATENT DOCUMENTS

| | | | | |
|---|---|---|---|---|
| 8,941,539 | B1 | 1/2015 | Bharghavan et al. | |
| 9,461,371 | B2 | 10/2016 | Kuonanoja | |
| 2011/0175792 | A1* | 7/2011 | Yoon | H01Q 1/521 343/893 |
| 2011/0228713 | A1 | 9/2011 | Alexopoulos et al. | |
| 2013/0154890 | A1 | 6/2013 | Jan et al. | |
| 2014/0038585 | A1 | 2/2014 | Xin et al. | |
| 2015/0116153 | A1* | 4/2015 | Chen | H01Q 13/103 342/359 |
| 2015/0295311 | A1 | 10/2015 | Bringuier et al. | |
| 2016/0049736 | A1 | 2/2016 | Liu et al. | |
| 2016/0141767 | A1* | 5/2016 | Zhai | H01Q 1/521 343/893 |
| 2016/0301145 | A1* | 10/2016 | Lee | H01Q 9/42 |
| 2017/0069974 | A1 | 3/2017 | Shamblin et al. | |

FOREIGN PATENT DOCUMENTS

| | | | |
|---|---|---|---|
| CN | 102142870 | A | 8/2011 |
| CN | 102201614 | A | 9/2011 |
| CN | 102593581 | A | 7/2012 |
| CN | 203589203 | U | 5/2014 |
| CN | 104037491 | A | 9/2014 |
| CN | 105375098 | A | 3/2016 |
| CN | 205211920 | U | 5/2016 |
| CN | 106505306 | A | 3/2017 |

* cited by examiner

*Primary Examiner* — Dimary S Lopez Cruz
*Assistant Examiner* — Amal Patel

(57) ABSTRACT

Antennas and MIMO antenna systems in a housing of an electronic device are described. Each of the antennas includes a first RF radiating member having a first frequency range and a second RF radiating member having a second frequency range. The first frequency range is 4-5 GHz and the second frequency range is 3-4 GHz, and each antenna has an operating frequency range of at least 3-5 GHz. A plurality of the antennas may be arranged in a housing of an electronic device to form MIMO antenna systems.

15 Claims, 11 Drawing Sheets

BROADBAND SUB 6GHZ MASSIVE MIMO ANTENNAS FOR ELECTRONIC DEVICE

The present disclosure relates to antennas, and in particular, to broadband antennas and arrangements of antenna systems in an electronic device.

BACKGROUND

Ever more functionality and technology are being integrated into modern electronic devices, such as smart phones. Sometimes, additional hardware may need to be added to the electronic device in order to provide new functionality. For example, additional antennas will be required to support 5G technologies in a modern electronic device.

There is, however, very limited additional space in the electronic device for placing additional antennas, especially when the additional antennas compete space with other additional hardware on the Printed Circuit Board (PCB) of the electronic device. Furthermore, the layout of the PCB may need to be substantially changed or rearranged in order to connect additional antennas on the ground plane of the PCB.

5G frequency bands in different countries may range from 3 GHz to 5 GHz. Therefore, it is desirable to provide additional antennas in an electronic device that covers these potential 5G frequency bands.

SUMMARY

The present description describes example embodiments of broadband Sub 6 GHz antennas and arrangements of antenna systems that may be conveniently implemented in an electronic device, such as a 5G electronic device. The antennas and arrangements of antenna systems provide broad bandwidth from 3-5 GHz, high efficiency, low correlation and hybrid UE Wi-Fi antenna applications. The antennas and arrangements of antenna systems can be introduced in the electronic device without interfering or modifying the existing arrangement of the hardware components of the electronic device.

According to one aspect, there is provided an electronic device that includes a radio frequency (RF) communications circuit; and a multiple input multiple output (MIMO) antenna array including a plurality of antennas connected to the RF communications circuit, each antenna including a first RF radiating member having a first frequency range and a second RF radiating member having a second frequency range.

Optionally, in any of the preceding aspects, the first frequency range is 4-5 GHz and the second frequency range is 3-4 GHz, and each antenna has an operating frequency range of at least 3-5 GHz.

Optionally, in any of the preceding aspects, the antennas are arranged in pairs supported in a housing of the electronic device, each antenna pair including a first antenna and a second antenna that have a different physical configuration than each other.

Optionally, in any of the preceding aspects, the housing has four corners and the MIMO array includes four of the antenna pairs, each antenna pair being located at a respective corner of the housing.

Optionally, in any of the preceding aspects, the first antenna and second antenna in each antenna pair are arranged at the respective corner so that any RF mutual coupling therebetween will not exceed a maximum threshold of −10 dB from 3 GHz to 5 GHz.

According to another aspect, there is provided a multiple input multiple output (MIMO) antenna array that includes a plurality of antennas for transmitting RF signals from a transmitter of an electronic device and for receiving external RF signals, each antenna including a first RF radiating member having a first frequency range and a second RF radiating member having a second frequency range.

Optionally, in any of the preceding aspects, the first frequency range is 4-5 GHz and the second frequency range is 3-4 GHz, and each antenna has an operating frequency range of at least 3-5 GHz.

Optionally, in any of the preceding aspects, the antennas are arranged in pairs supported in a housing of an electronic device, each antenna pair including a first antenna and a second antenna that have a different physical configuration than each other.

Optionally, in any of the preceding aspects, the housing has four corners and the MIMO array includes four of the antenna pairs, each antenna pair being located at a respective corner of the housing.

BRIEF DESCRIPTION OF THE DRAWINGS

Reference will now be made, by way of example, to the accompanying drawings which show example embodiments of the present disclosure, and in which.

Similar reference numerals may have been used in different figures to denote similar components.

DESCRIPTION OF EXAMPLE EMBODIMENTS

Newer radio access technologies (RATs), for example 5G technologies, require faster data rates and greater data streams in the air interface. A multiple-input and multiple-output (MIMO) antenna system may be used to increase the capacity of wireless channels without extra radiation power or spectrum bandwidth. In a multipath wireless environment, the capacity of wireless channels generally increases in proportion to the number of transmitter and receiver antennas of a MIMO antenna system.

Figure 1:
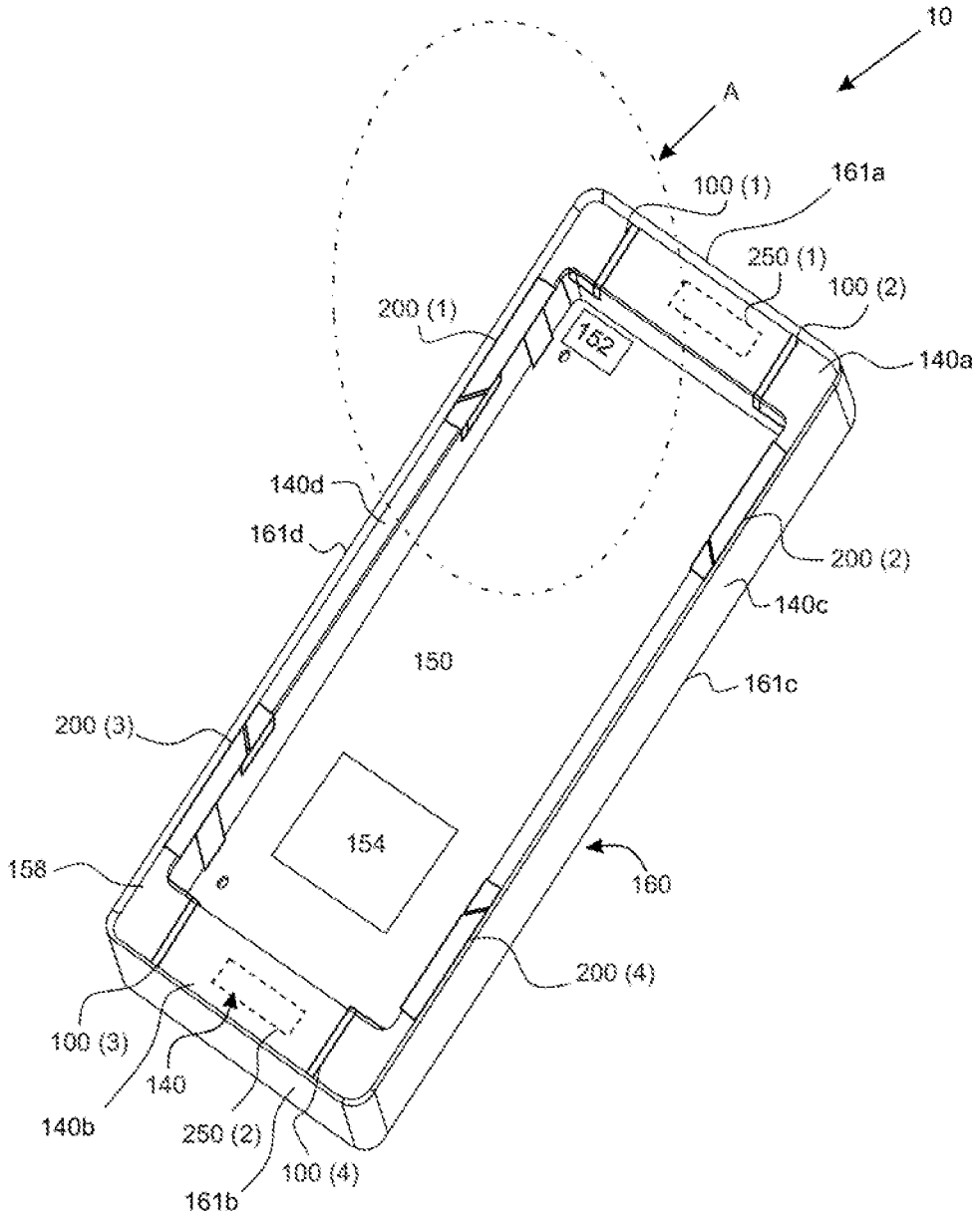
FIG. 1 is a back perspective view of an electronic device having an array of eight antennas, according to a first arrangement of example embodiments.

In this regard, FIG. 1 illustrates a bottom view of an exemplary electronic device 10 that implements MIMO antenna system according to the present disclosure. The electronic device 10 may be a mobile device that is enabled to receive and transmit radio frequency (RF) signals including, for example, a tablet, a smart phone, a Personal Digital Assistant (PDA), or an Internet of Things (IOT) device, among other things.

Figure 2:
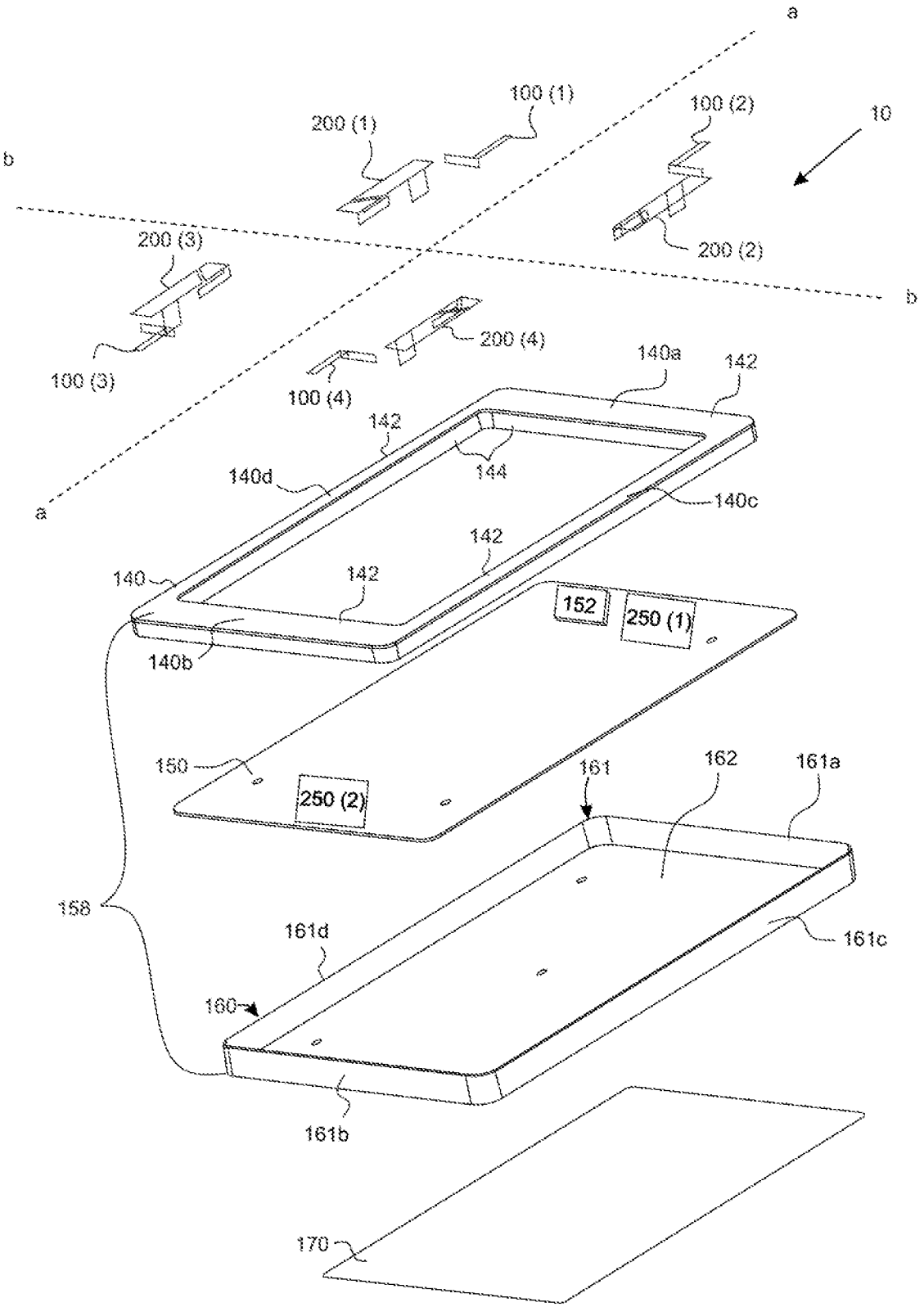
FIG. 2 is an exploded view of the electronic device of FIG. 1.

As illustrated in the example of FIG. 2, the electronic device 10 includes a housing 158 that supports, among other things, a MIMO antenna system (described in detail below), a PCB board 150 populated with electronic components, a display screen 170, and a battery 154 (see FIG. 1).

Electronic devices intended for handheld use typically have a rectangular prism configuration with a top and bottom of the device that correspond to the orientation that the device is most commonly held in during handheld use, and in this regard the terms "top", "bottom", "front" and "back" as used in the present disclosure refer to the most common use orientation of the electronic device 10 as intended by the device manufacturer, while recognizing that some devices can be temporarily orientated to different orientations (for example from a portrait orientation to a landscape orientation). In examples in which the electronic device 10 has a display screen 170, the term "front" refers to the surface of the device on which screen 170 is located.

In the example device shown in FIGS. 1 and 2, a plurality of antennas are arranged in the electronic device 10 to implement the MIMO antenna system. These antennas include first and second arrays of antennas 100(1)-100(4) and 200(1) to 200(4) (referred to generically as antennas 100 and 200). In example embodiments, first antennas 100 each have an identical physical configuration and second antennas 200 each have an identical physical configuration that is different than that of the first antennas 100. Despite physical differences, both the first and second antennas 100, 200 are configured to operate in the same frequency range, for example, from 3 GHz-5 GHz.

In the example embodiment of FIGS. 1-2, the housing 158 of the electronic device 10 includes an antenna support member 140 that functions as an antenna carrier for antennas 100, 200, and a housing frame 160 that supports the antenna support member 140. Although the housing frame 160 and antenna support member 140 of housing 158 are shown as two components in FIGS. 1-3, in at least some example embodiments, features of support member 140 are integrated into the housing frame 160 to provide a housing 158 with a unitary structure. The antenna support member 140 includes a top portion 140*a* and a bottom portion 140*b* interconnected by two parallel side portions 140*c* and 140*d*. Each of the top portion 140*a*, bottom portion 140*b*, and two side portions 140*c* and 140*d* define a respective back surface 142 that is substantially parallel to and faces in an opposite direction than the display screen 170, and an inner surface 144 that is substantially orthogonal to the back surface 142 and faces the inside of the electronic device 10. The back and inner surfaces 142, 144 of the support member 140 provide support to the antennas 100 and 200 without interfering with the other hardware components of the electronic device 10. The inner surfaces 144 of the top portion 140*a*, bottom portion 140*b*, and two side portions 140*c* and 140*d* collectively from a rectangular perimeter that defines a central region for receiving hardware components integrated on the PCB 150. The support member 140 may be placed on top of a periphery of the PCB 150. The support member 140 may be attached to the housing frame 160, for example by adhesives, or, as noted above, be integrated in the housing frame 160. The configuration of the support member 140 may be varied as long as it provides support to the antennas 100 and 200 at selected positions inside the electronic device 10 without interfering with the arrangement of the other hardware components of the electrical device 10.

In some example embodiments, the PCB 150 includes a plurality of layers including at least one signal layer and at least one ground layer. The signal layer includes a plurality of conductive traces that each forms signal paths 116 between respective PCB pads (see FIG. 3). The ground layer of the PCB 150 provides shielding and a common ground reference in the PCB 150 for current returns of the electronic components, and includes a plurality of conductive traces that each form ground paths 118 (see FIG. 3). Conductive vias are provided through the PCB 150 to extend the signal paths 116 and ground paths 118 to surface connection points (such as pads) on the PCB 150. Electronic components are populated on the PCB 150 to form circuits capable of performing desired functions. Electronic components may include, for example, integrated circuit (IC) chips, capacitors, resistors, inductors, diodes, transistors and other components.

The electronic device 10 may also include other hardware such as sensors, speakers, cameras and various circuits formed by electronic components populated on the PCB 150. Additional antennas 250 configured for RATs that are different than the RATs targeted by antennas 100, 200 may be placed on the top and bottom portions of PCB board 150.

In example embodiments, an RF communications circuit is implemented by PCB 150 and the components populated on PCB 150. By way of example, RF communications circuit can include signal and ground paths 116, 118, an RF transceiver circuit 152, electrical connectors (for example coax cables) for connecting to antennas 100, 200 or 250, and other circuitry required for handling RF wireless signals. In example embodiments, RF transceiver circuit 152 can be formed from one or more integrated circuits and include modulating circuitry, power amplifier circuitry, low-noise input amplifiers and other components required to transmit or receive RF signals.

In an example, transceiver circuit 152 includes components to implement transmitter circuitry that modulates baseband signals to a carrier frequency and amplifies the resulting modulated RF signals. The amplified RF signals are then sent from the transceiver circuit 152 using signal path 116 and ground path 118 to the antennas 100, 200 which then radiate the amplified RF signals into a wireless transmission medium. In an example, transceiver circuit 152 also includes components to implement receiver circuitry that receives external carrier frequency modulated RF signals through signal path 116 and ground path 118 from the antennas 100,200. The transceiver circuit 152 may include a low noise amplifier (LNA) for amplifying the received signals and a demodulator for demodulating the received RF signals to baseband. In some examples, RF transceiver circuit 152 may be replaced with a transmit-only circuitry and in some examples, RF transceiver circuit 152 may be replaced with a receive-only circuitry.

The antennas 250 that are used for other RATs than antennas 100 200 may, in some examples, be connected to a different transceiver circuit than transceiver circuit 152.

In example embodiments, electronic device 10 includes a battery 154 for supplying power to electronic device 10. Battery 154 is electrically connected to a power supply circuit of the PCB 150. The power supply circuit then supplies power to circuits on the PCB 150, such as RF communications circuit, or to other electronic components of the electronic device 10. In an example illustrated in FIG. 1, battery 154 is placed above the PCB 150 and inside the housing 158. Battery 154 may also be directly placed on PCB 150, for example, on the middle of PCB 150. Battery 154 may have a substantial size and occupy a substantial space of the housing 158. In an example, battery 154 has dimensions of 60 mm (width)×90 mm (length)×5 mm (height).

In some examples, battery 154 includes metal materials, and therefore absorbs RF wave energy radiated from antenna 100 and 200. In this case, comparing with efficiency of antennas 100 and 200 without battery 154 in the electronic device 10, efficiency of antennas 100 and 200 with the battery 154 in the electronic device 10 may be reduced, for example, by 10%.

As illustrated in FIG. 2, the housing frame 160 includes a planar support element 162 with a perpendicular rim or sidewall 161 that extends around a perimeter of the planar support element 162. A back cover (not shown) is configured to cooperate with the housing frame 160. In an embodiment, the housing frame 160, and the back cover together securely enclose hardware of the electronic device 10, such as antennas 100, 200, the PCB board 150, and other hardware of the electronic device 10. In example embodiments, the display screen 170 is secured to a front of the housing frame 162.

In the examples of FIGS. 1 and 2, the sidewall 161 of housing frame 160 includes a top wall portion 161*a*, a bottom wall portion 161*b* and two opposite side wall portions 161*c* and 161*d* that extend between the top and bottom wall portions 161*a* and 161*b*. In at least some example embodiments, the side wall portions 161*c* and 161*d* of the housing frame 160 have a greater length than the top wall portion 161*a* and bottom wall portion 161*b* of the housing 102.

Figure 3:
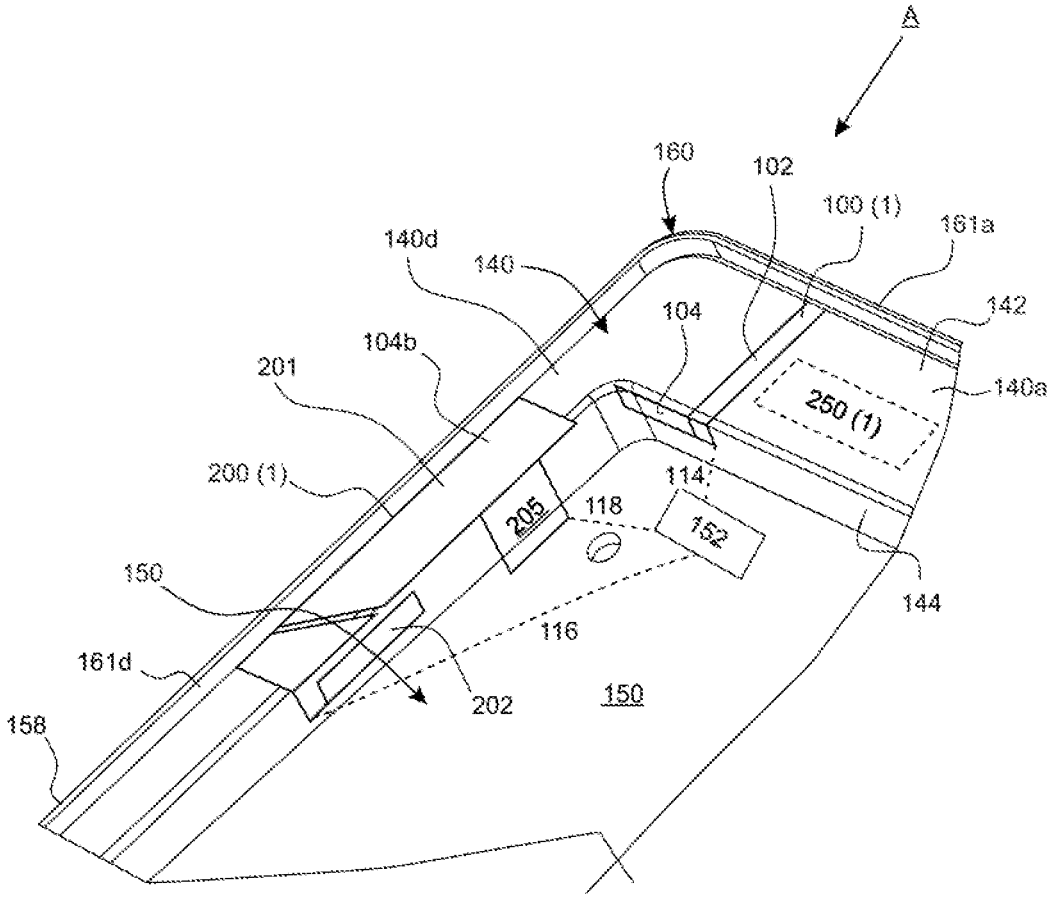
FIG. 3 is an enlarged view of portion A of FIG. 1.

In embodiments in which the support member 140 and housing frame 160 are integrated together into a unitary housing 158, elements of the support member 140 can be integrated into the sidewall 161 to support to the antennas 100 and 200 at the respective positions shown in FIGS. 1 to 3. For example, the housing 158 may include protrusions extending from the sidewall 161 of the housing frame 160 and towards internal region of the housing 158 to provide support to the antennas 100 and 200 at their respective locations. In some example embodiments, the antennas 100 and 200 are each secured to at least one of the back 142 and inner surfaces 144 of support member 140 with an adhesive, for example, copper glue. In some example embodiments, the antennas 100 and 200 are each secured to support member 140, using an insert molding process. In some example embodiments, the antennas 100 and 200 are each secured to the support member 140 using a laser direct structuring (LDS) process. In some example embodiments, the antennas 100 and 200 are secured to the support member 140 by a flex tape process in which each of the antennas 100 and 200 are mounted on a respective flex PCB that is then mounted using an adhesive with the antennas 100 and 200 to the support member 140.

In some example embodiment, the support member 140 and housing frame 160 are formed from suitable material, such as plastic, carbon-fiber materials or other composites, glass, or ceramics.

In some example embodiments, the PCB 150 of the electronic device 10 is located parallel to planar support element 162 and may be secured to standoffs that are located on the planar support element 162. In some examples, planar support element 162 is located rearward of the antennas 100, 200 rather than forward of the antennas as shown in FIG. 2, and may also serve as the back cover of the electronic device 10. In such example, the planar support element 162 can provide a support surface for the antennas 100, 200.

In example embodiments, the antennas 100, 200 are secured in respective locations on the housing 158 that have been selected to optimize MIMO performance in the compact environment of a handheld electronic device. In particular, antenna locations are selected to achieve at least one of the following, or an optimal combination of the following: mitigate electrical interference with other components in the electronic device 10, mitigate RF blocking by a user of the electronic device 10, mitigate coupling between antennas, and optimize diversity gain.

In this regard, in the illustrated embodiment of FIGS. 1-3, pairs of antennas are positioned at each corner of the housing 158 of electronic device 10. Each antenna pair includes a first antenna 100 and a second antenna 200, which as noted above have different physical configurations but are configured to operate within the same frequency range. The antennas 100, 200 in each pair are supported by the housing at orthogonal locations to each other. For example, as shown in FIG. 3, antenna 100(1) is supported at a corner of the housing 158 on top portion 140*a* and antenna 200(2) is at the same corner is supported on a side portion 140*d* that extends at a right angle from the top portion 140*a*.

Antenna 100

Figure 4:
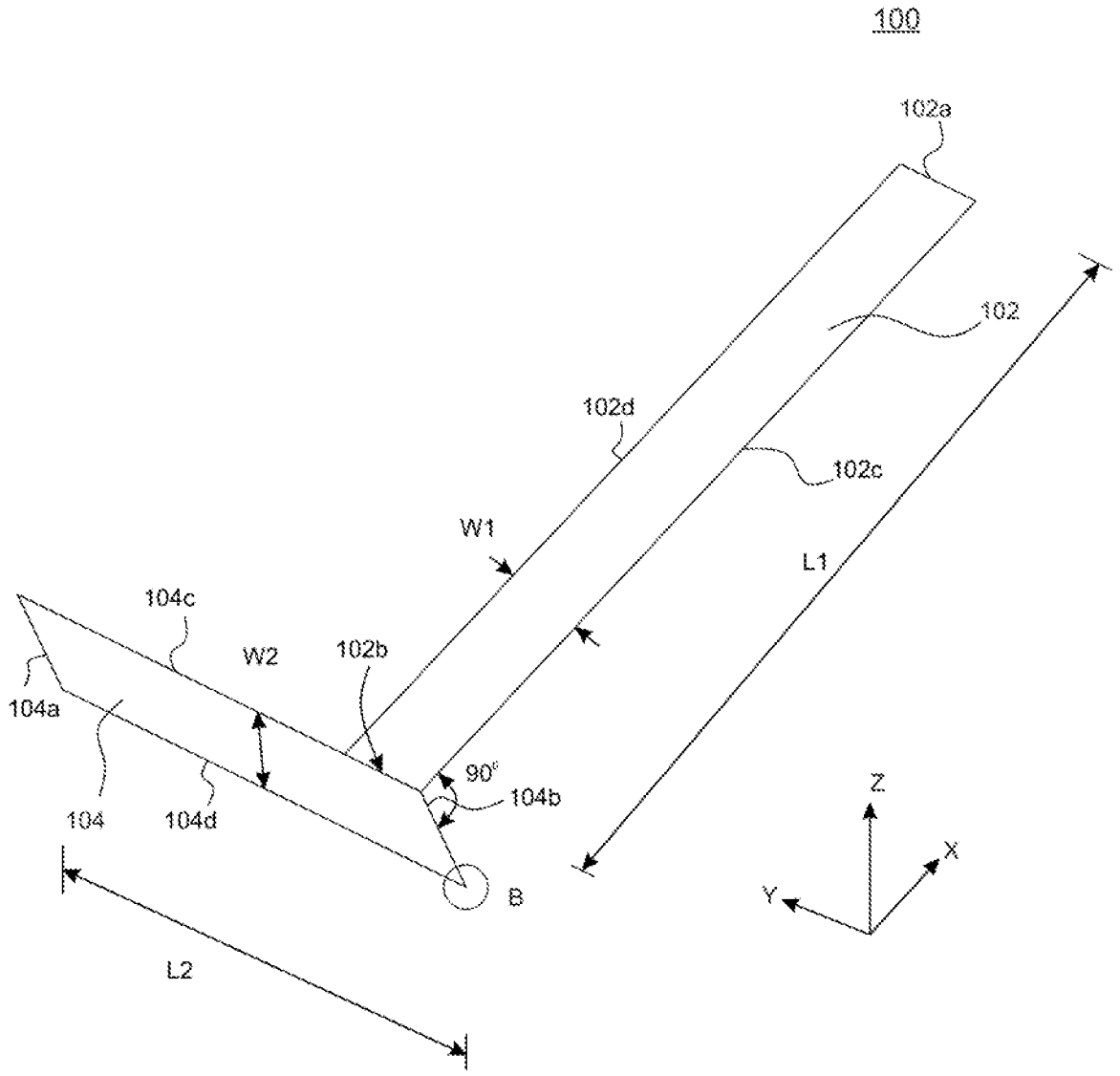
FIG. 4 is a perspective view of an antenna, according to example embodiments.
Figure 5:
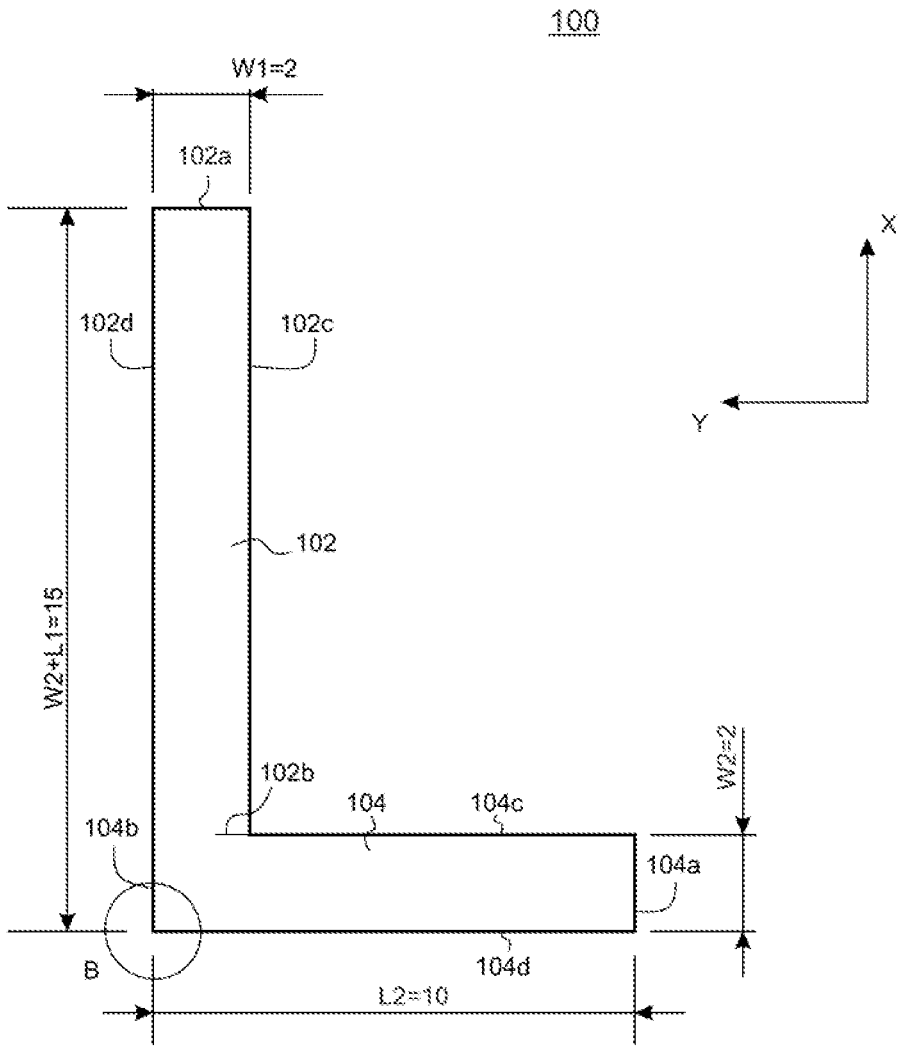
FIG. 5 is a perspective view of an antenna, according to example embodiments.

FIGS. 4 and 5 illustrate an example embodiment of antenna 100 that is capable of transmitting RF signals received from a transmitter of the transceiver circuit 152 of the electronic device 10 and receiving external RF signals for further processing by a receiver of the transceiver circuit 152 of the electronic device 10.

As shown in FIG. 4, antenna 100 includes a first radiating member 102 and a second radiating member 104. The first radiating member 102 and the second radiating member 104 are made of a conductive material, for example, a metal such as copper. As illustrated in the example of FIG. 4, the first radiating member 102 and the second radiating member 104 are each substantially planar rectangular elements.

The rectangular first radiating member 102 has a length L1 that is greater than a width W1, and is defined by first and second ends 102*a* and 102*b*, and parallel side edges 102*c* and 102*d*. The ends 102*a*, 102*b* correspond to width W1 and the side edges 102*c*, 102*d* correspond to the length L1. The second radiating member 104 has a length L2 that is greater than a width W2, and is defined by first and second side edges end 104*c* and 104*d*, and two parallel ends 104*a* and 104*b*. The side edges 104*c*, 104*d* correspond to the length L2 and the side edges 102*a*, 102*b* correspond to the width W2.

The second end 102*b* of the first radiating member 102 is electrically connected to an end portion of the side edge 104*c* of the second radiating member 104. Referring to the orthogonal X, Y, Z reference coordinate system shown in FIG. 4, the first and second radiating members 102, 104 are orthogonal to each other in two planes. In particular, the radiating member 102 extends in the X-Y plane with its length L1 (i.e. its major axis) parallel to the X axis, and the radiating member 104 extends in the Y-Z plane with it length L2 (i.e. Its major axis) parallel to the Y axis. The first radiating member 102 and second radiating member 104 function as two monopole antennas that are each oriented in different directions. The first radiating member 102 and the second radiating member 104 receive RF waves that linearly polarized from different directions, including for example vertically polarized RF signals and horizontally polarized signals. As such, the combination of the first radiating member 102 and the second radiating member 104 of antenna 100 may in some applications provide better performance, such as diversity gain, than a single monopole antenna when receiving linearly polarized RF signals from various directions in a multipath propagation environment.

In an example, the end 102*b* of first radiating member 102 is electrically connected to the side edge 104*c* of the second radiating member 104 by a weld. In another example, the first radiating member 102 and the second radiating member 104 are formed from a conductive sheet that is cut into an L-shape such as shown in FIG. 5 and folded ninety degrees at the boundary between radiating member 102 end 102*b* and radiating member 104 side edge 104*c*.

The three dimensional configuration of antenna 100 as shown in FIG. 4 requires three dimensional space to receive antenna 100 in the electronic device 10. In some example embodiments, as illustrated in the example of antenna 100 (1) shown in FIG. 3, the first radiating member 102 is located on the back surface 142 of the top portion 140*a* of the support member 140 and the second radiating member 104 is located on the inner surface 144 that is substantially perpendicular to the back surface 142 of the top portion 140*a*.

In an example embodiment, the RF feed point for antenna 100 is near the corner of the side edge 104*d* and second end 104*b* of the second antenna member 104, for example, at region B in FIG. 4. As the first radiating member 102 is electrically connected at its end 102*b* to the side edge 104*c* of the second radiating member 104, RF signals fed to region B from transceiver circuit 152 are fed to the first radiating member 102 and the second radiating member 104 substantially from their respective ends 102*b* and 104*b*. Similarly, RF signals received over an air interface at radiating members 102 and 104 are fed though feed region B to transceiver 152.

In some embodiments, as illustrated in FIG. 3, a cable 114 is used to connect the feed region B of antenna 100 to a pad on PCB board 150 that is connected by a signal path 116 to the transceiver 152. In some examples, cable 114 is coaxial and includes a conductor, a metal sheath, and an insulation layer between the core and the metal sheath. The conductor, which is the core of the cable, exchanges RF signals between the signal path 118 and antenna 100. In example embodiments antenna 100 does not have a physical ground connection and the metal sheath, which is not connected to antenna 100, connects the common ground of the PCB 150, so that the common ground of PCB 150 provides a grounding plane for antenna 100.

In an example, the conductor exposed outside the cable is no longer than 2 mm, so that the additional impedance introduced by the conductor exposed outside the cable is negligible.

In example embodiments, the length L1 of first radiating member 102 is different than the length L2 of the second radiating member 104, causing the first radiating member 102 and the second radiating member 104 to have different resonant frequencies. In an example embodiment, dimensions of the first radiating member 102 and second radiating member 104 are respectively selected to configure the longer first radiating member 102 having an operating frequency range of 3-4 GHz, and the second radiating member 104 to having an operating frequency range of 4-5 GHz. Collectively, the combination of the first radiating member 102 and the second radiating member 104 in this example allows antenna 100 to operate over the frequency range of 3-5 GHz. In a particular example embodiment, the first radiating member 102 has a length of L1=13 mm, and the second radiating member 104 has a shorter length of L2=10 mm. Each of the first radiating member 102 and second radiating member 104 has a width W1=W2=2 mm.

In some example embodiments, the dual monopole antenna 100 can have a configuration different from that shown in FIG. 4. For example, in some embodiments the antenna 100 may not be folded and instead may be flat such as shown in FIG. 5. In the embodiment of FIG. 5, the antenna 100 is planar, with both first radiating member 102 and second radiating member 104 located in a common plane (for example the X-Y plane). Similar to antenna 100 of FIG. 4, the radiating members 102, 104 extend lengthwise at a 90 degree angle to each other from feed point region B. This flat configuration of antenna 100 shown in FIG. 5 requires a two dimensional mounting space in the electronic device 10. Antenna 100 in this configuration could for example be attached to surfaces of support member 140 or on the surfaces of housing frame 160, or to the back cover of the electronic device 10.

As shown in FIGS. 4 and 5, antenna 100 has a compact size and can conveniently fit in the housing frame 160 of the electronic device 10 without modifying the arrangement of the existing hardware components of electronic device 10. The particular selection of antenna 100 can depend on factors such as the internal configuration of electronic device 10 and the availability of space for the antennas.

Antenna 200

Figure 6:
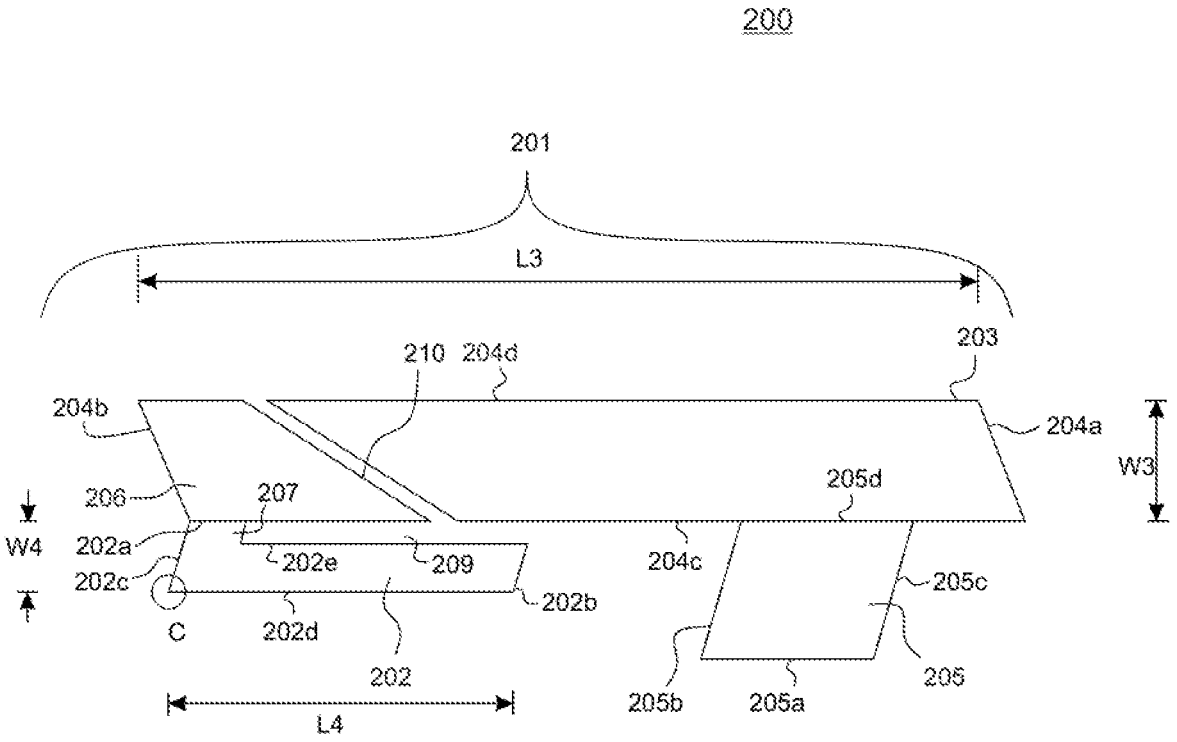
FIG. 6 is a perspective view of an antenna, according to example embodiments.
Figure 7:
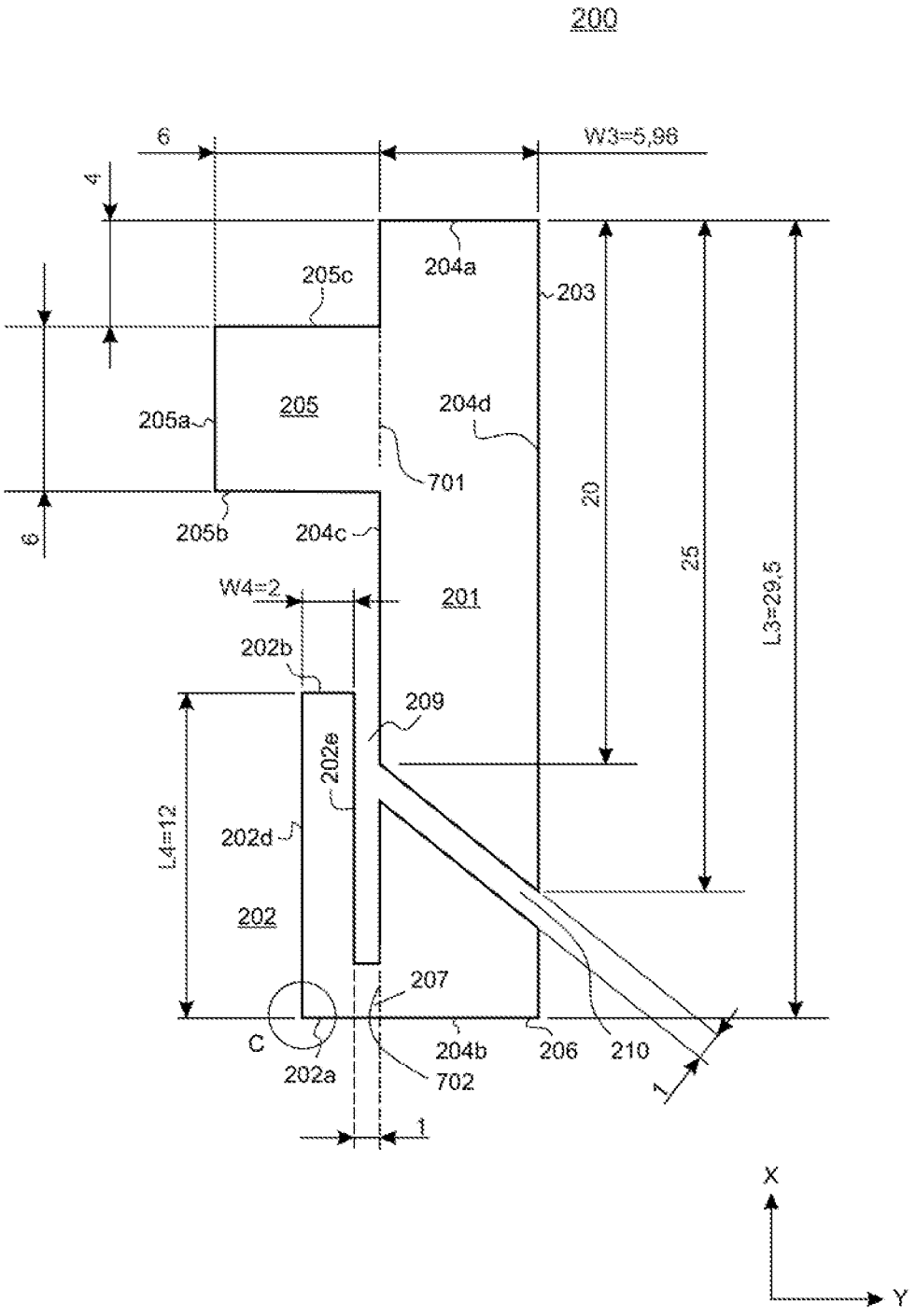
FIG. 7 is a perspective view of an antenna, according to example embodiments.

FIGS. 6 and 7 illustrate an example embodiment of antenna 200 that is capable of transmitting RF signals received from a transmitter of the transceiver circuit 152 of the electronic device 10 and receiving external RF signals for further processing by a receiver of the transceiver circuit 152 of the electronic device 10.

Antenna 200 includes a first radiating member 201, a second radiating member 202, and a shorting element 205. Antenna 200 is formed from a conductive material, for example a metal such as copper. As illustrated in the example of FIGS. 6 and 7, the first radiating member 201 and the second radiating member 202 are each substantially planar rectangular elements. The rectangular first radiating member 201 has a length L3 between opposite ends 204*a*, 204*b*, and a width W3 between opposite side edges 204*c*, 204*d*. Second radiating member 202 has a length L4 between its opposite ends 202*b*, 202*c*, and a width W4 between its opposite side edges 202*e*, 202*d*. The first rectangular radiating member 201 is separated into a first, larger, resonating body 203 and a second, smaller, resonating body 206 by an angled gap or slot 210 that extends between side edges 204*c*, 204*d*.

The angled slot 210 provides a capacitive element integrated into the first radiating member 201 such that the angled slot 210 enables the overall size of the antenna 200 to be smaller with respect to a given bandwidth than the antenna would be without the angled slot 210. As well, the angled slot 210 improves impedance match between antenna 200 and transceiver 152. In example embodiments the angled slot 210 has a uniform width (for example 1 mm) and extends at an angle of between 30°-60° relative to end 204*b*, for example 45°. The slot angle is selected to provide a slot length that achieves, with the slot width, a desired capacitive effect.

In the Example of FIG. 6, the first radiating member 201 and a second radiating member 202 extend in perpendicular planes relative to each other with their major axes being parallel to each other. Side edge 202*e* of the second radiating member 202 is substantially parallel to side edge 204*c* of the first radiating member 201, with a space 209 of uniform width defined between the side edges 202*e*, 204*c*. A connecting member 207 spans the space 209 to electrically connect side edge 202*e* at end 202*c* of the second radiating member 202 and side edge 204*c* at end 204*b* of the first radiating member 201.

Shorting element 205 extends perpendicular to first radiating member 201 in the same plane as second radiating member 202, and has two ends 205*a* and 205*d* and two side edges 205*b* and 205*c*. One end 205*d* of the shorting element 205 is electrically connected to the second portion 204 of the first radiating member 201 close to the distal end 204*a*. The other end 205*a* is connected to a ground of the electronic device 10. In the example of FIGS. 6 and 7, the shorting element 205 has a substantially rectangular shape.

The shorting element 205 is used for electrically connecting the antenna 200 with the common ground of the PCB board 150. For example, the shorting element 205 connects through a wire with the common ground of the PCB board 150 or connects with the common ground of the PCB board 150 via a spring contact. In an example, shorting element 205 is electrically connected to a common ground through the ground path 118 of the PCB 150, as illustrated in FIG. 3.

In an example, the first radiating member 201, second radiating member 202, connecting member 207 and shorting element 205 are cut from a common planar conductive sheet to form a planar structure such as shown in FIG. 7, and the second radiating member 202, connecting member 207 and shorting element 205 are then folded perpendicular to first radiating member 201 along respective fold lines 702 and 701 to provide the three dimensional antenna structure shown in FIG. 6. In some alternative embodiments, one or more if the first radiating member 201, the shorting element 205, the second radiating member 202, and the connecting member 207 can be formed as separate pieces and then electrically connected by welding the pieces together.

In the illustrated embodiments in FIGS. 6 and 7, the RF feed point for antenna 200 is at the region close to the corner of the sides 202*a* and 202*d* of the second radiating member 202, for example at region C on FIGS. 6 and 7. RF signals fed to region C from transceiver circuit 152 are fed directly to the second radiating member 202 and to the first radiating member 201 through the connecting member 207. Similarly, RF signals received over an air interface at radiating members 201 and 202 are fed though feed region C to transceiver 152. In some embodiments a cable 114 is used to connect the feed region C of antenna 200 to a pad on PCB board 150 that is connected by a signal path 116 to the transceiver 152.

As Illustrated in FIG. 6, the first radiating member 201 is on a first plane, such as XY plane, the second radiating member 202 and the shorting element 205 are on a second plane substantially perpendicular to the first plane, such as XZ plane. This configuration of antenna 200 requires three dimensional space to receive antenna 200 in the electronic device 10. In some example embodiments, as illustrated in the example of antenna 200(1) shown in FIG. 3, the first radiating member 201 is located on the back surface 142 of a side portion 140*d* of the support member 140 and the second radiating member 202 and shorting element 205 are located on the inner surface 144 of the support member 140 that is substantially perpendicular to the back surface 142.

In some embodiments the first radiating member 201, second radiating member 202 and shorting element 205 are all located in the same plane such as shown in FIG. 7, the XY plane. This configuration of antenna 200 requires a substantially two dimensional space to receive antenna 200 in the electronic device 10. For example, antenna 200 in this configuration can be attached, in whole or in part, to back surfaces of support member 140 or on the surfaces of housing frame 160, for example, on the surface of the front or back covers of housing 158. Based on the arrangement of existing hardware components of electronic device 10 and available free space inside the housing 158, different configurations of antenna 200 may be selected.

In example embodiments, the first radiating member 201 and second radiating member 202 of antenna 200 functions as two antenna elements for radiating and receiving RF signals. In particular, the first radiating member 201 functions as a PIFA (Planer Inverted F) antenna and the second radiating member 202 functions as a monopole antenna. The first radiating member 201 has a different length than the second radiating member 202. As such, the first radiating member 201 and the second radiating member 202 have different frequency ranges.

FIG. 7 shows exemplary dimensions of antenna 200 in mm. The first radiating member 201 has a total length of L3=29.5 mm and width W3=to about 6 mm. The length of the longer side of resonating body 203 is 25 mm and its shorter side is 20 mm. The distance between the side 205*c* of the shorting element 205 and the distal end 204*a* of the radiating member 201 is about 4 mm. The shorting element 205 is 6 mm by 6 mm. The width of the angled slot 210 in first radiating member 201 is 1 mm. The width of the space 209 between the side 204*c* of first resonating body 203 and the side 202*e* of the second radiating member 202 is about 1 mm. The length L4 of the side 202*d* of the second radiating member 202 is about 12 mm. The width W4 of the side 208*b* of the second radiating member 202 is about 2 mm. Dimensions of the first member 202 and second member 202 may be varied with different resonant frequencies.

With the exemplary dimensions of FIG. 7, the first radiating member 201 of the antenna 200 covers a Wi-Fi and Bluetooth 2.4 GHz frequency band and a frequency range of 3-4 GHz. The second radiating member 202 is smaller than the first radiating member 201 and has an operating frequency range of 4-5 GHz. As well, the antenna 200 as a whole also covers the 5.8 GHz Wi-Fi frequency band. As such, with the combination of the first and second radiating members 201 and 202, the antenna 200 covers frequency range of 3-5 GHz and 5.8 GHz Wi-Fi frequency band and 2.4 GHz Wi-Fi and Bluetooth frequency bands, providing a total operating frequency range of 2.4 GHz to 5.8 Ghz.

As shown in FIGS. 6 and 7, the angled slot 210 allows antenna 200 to have a compact size and can conveniently fit in the housing frame 160 of the electronic device 10 without modifying the arrangement of the existing hardware components of electronic device 10.

Performance of Antennas 100 and 200

In at least some applications, measured results have indicated that antenna 100 with exemplary dimensions illustrated in FIG. 5 and antenna 200 with exemplary dimensions illustrated in FIG. 7 have broad bandwidth, high efficiency, low correlation and hybrid Wi-Fi and Bluetooth antenna applications. According to measured results, when the battery 154 is included in electronic device 10, each of antenna 100 and antenna 200 has a total efficiency above 55% in the frequency range from 3 GHz to 5 GHz, above 60% at 3.5 GHz and 4.8 GHz, and above 60% at 2.4 GHz and 5.8 GHz Wi-Fi frequency ranges and 2.4 GHz Bluetooth frequency range.

Antenna 100 with exemplary dimensions illustrated in FIG. 5 and antenna 200 with exemplary dimensions illustrated in FIG. 7 also have a good impedance matching with the output impedance of the transceiver 152 of the electronic device 100 at the frequency range of 3 GHz to 5 GHz.

According to measured results, each of antenna 100 and antenna 200 has a scattering parameter $S_{Rx\text{-}Rx}$ equal or substantially less than −10 dB from 3 GHz to 5 GHz.

As well, in some applications, antennas 100 and 200 are compatible with previous 2G, 3G, 4G and LTE UE antenna technologies.

First Exemplary 8×8 MIMO Antenna System—Antennas 100 and 200

An exemplary 8×8 MIMO antenna system is illustrated in FIGS. 1-2. Eight antennas 100(1)-100(4) and 200(1)-200(4) are supported by and secured to the support member 140 in the housing 158, for example by copper glue. As illustrated in FIGS. 1-2, four pairs of antennas 100 and 200 are arranged at the four corners of the housing 158 of electronic device 10. Each of the antennas 100(1)-100(4) and 200(1)-200(4) is electrically connected to the transceiver 152 on the PCB 150.

In an example embodiment, first antenna pair 100(1), 200(1) and second antenna pair 100(2), 200(2) are substantially symmetrical to each other with respect to a longitudinal central axis a-a (i.e. the major axis) of the housing 158. Third antenna pair 100(3), 200(3) and fourth antenna pair 100(2), 200(2) are also substantially symmetrical to each other with respect to longitudinal central axis a-a. First antenna pair 100(1), 200(1) and third antenna pair 100(3), 200(3) are substantially symmetrical to each other with respect to a latitudinal central axis b-b (i.e. the minor axis) of the housing 158. Second antennas pair 100(2), 200(2) and fourth antenna pair 100(4), 200(4) are also substantially symmetrical to each other with respect to latitudinal central minor axis b-b.

Each antenna 100, 200 in each antenna pair can be connected to transceiver 152 by a separate signal line 116, allowing incoming and outgoing signals for all eight antennas in the MIMO array to individually processed. Battery 154 supplies power to PCB 150 and transceiver 152. Furthermore, each antenna 100, 200 itself includes two radiating members that are each tuned for a different frequency range and oriented in a different direction. In example embodiments, the antennas 100, 200 in each pair are located sufficiently apart from each other to maintain any coupling between the antennas below a threshold level. For example, in one example, the antennas 100, 200 at each corner are located as close to the corner as they can be while having a mutual coupling level that will not exceed a maximum threshold of −10 dB from 3 GHz to 5 GHz. Additionally, in example embodiments the antenna pairs 100,200 are positioned and configured so that the Rx-Rx Envelope Correlation Coefficient between different antennas pairs is below 0.1 from 3 GHz to 5 GHz.

In some embodiments, one or more additional antennas 100, 200 are located in housing 158 to form MIMO antenna systems with more than 8 antennas.

By placing a pair of antennas 100 and 200 at each of the regions close to four corners of the electronic device 10, the 8×8 MIMO antenna system can, in at least some configurations, be introduced in electronic device 10 without interfering or modifying the existing arrangement of the hardware components of electronic device 10.

As well, because antennas 100 and 200 are placed in the housing frame 160 at regions close to the four corners of the electronic device 10, attenuation to the RF signals caused by a user's hand can be reduced in at least some configurations.

Second Exemplary 8×8 MIMO Antenna System—Antennas 100

Figure 8:
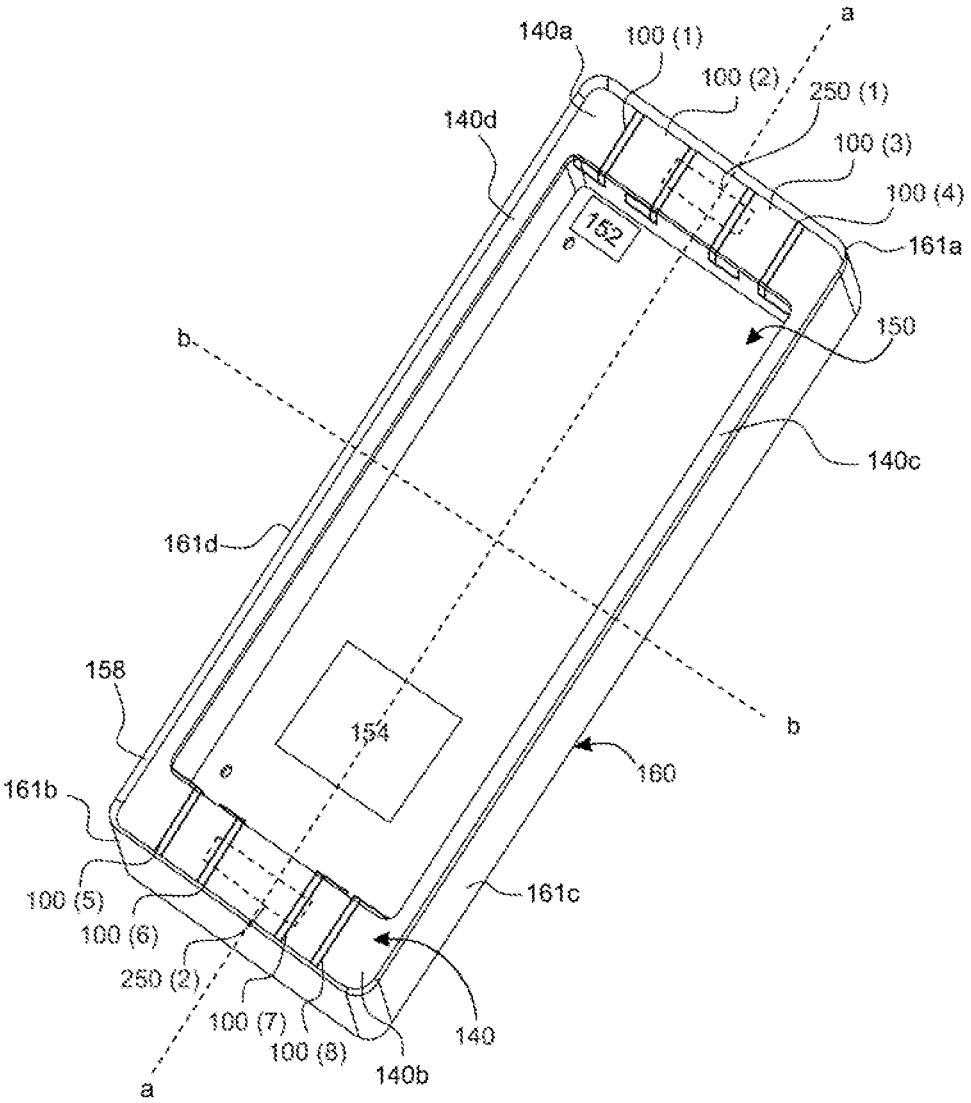
FIG. 8 is a back perspective view of an electronic device, according to a second arrangement of example embodiments.

FIG. 8 illustrates a further exemplary 8×8 MIMO antenna system which omits antennas 200 and instead includes eight antennas 100 located in housing 158. As shown in FIG. 8, 4 antennas 100(1)-100(4) are securely placed on the back surface of the top portion **140*a* of the support member 140, and 4 antennas 100(5)-100(8) are securely placed on the back surface of the bottom portion 140*b* of the support member 140, for example by copper glue. Each of antennas 100(1)-100(8) are electrically connected to the transceiver 152 on the PCB board 150. Battery 154 supplies power to PCB 150 and transceiver 152. In some examples, antennas 250(1) and 250(2) for other RATs, such as for 2G, 3G and 4G wireless communication technologies, are generally placed on the top and bottom portions of the PCB board 150. In some exemplary embodiments, the top portion 140*a* and the bottom portion 140*b* of the support member 140 are configured to be above antennas 250(1) and 250(2) and the antennas 100 may be placed on the back surface 142 and inner surface 144 of the top portion 140*a* or bottom portion 140*b* of the support member 140**.

In some example embodiments, antennas 100(1)-100(2) are substantially symmetrical with antennas 100(3)-100(4), and antennas 100(5)-100(6) are substantially symmetrical with antennas 100(7)-100(8), with respect to the longitudinal central axis a-a of the electronic device 10. In this case, the second radiating member 104 of the antennas 100(1)-100(2) and antennas 100(3)-100(4), and the second radiating member 104 of the antennas 100(5)-100(6) and antennas 100(7)-100(8), are oriented in opposite directions, as illustrate in the example of FIG. 8.

In some example embodiments, antennas 100(1)-100(4) are substantially symmetrical with antennas 100(5)-100(8), respectively, with respect to the latitudinal central axis b-b of the electronic device 10, as illustrate in the example of FIG. 8.

In the illustrated embodiment, some example embodiments, the first radiating members 102 of antennas 100(1)-100(4) and the first radiating members 102 of antennas 100(5)-100(8) are oriented parallel to axis a-a in opposite directions relative to each other, the inner facing second radiating members 104 of antennas 100 are parallel to axis b-b, with the second radiating members 104 of antennas 100(1), 100(2), 100(5), 100(6) oriented in a direction opposite that of the second radiating members 104 of antennas 100(3), 100(4), 100(7), 100(8)-100(8).

Figure 9:
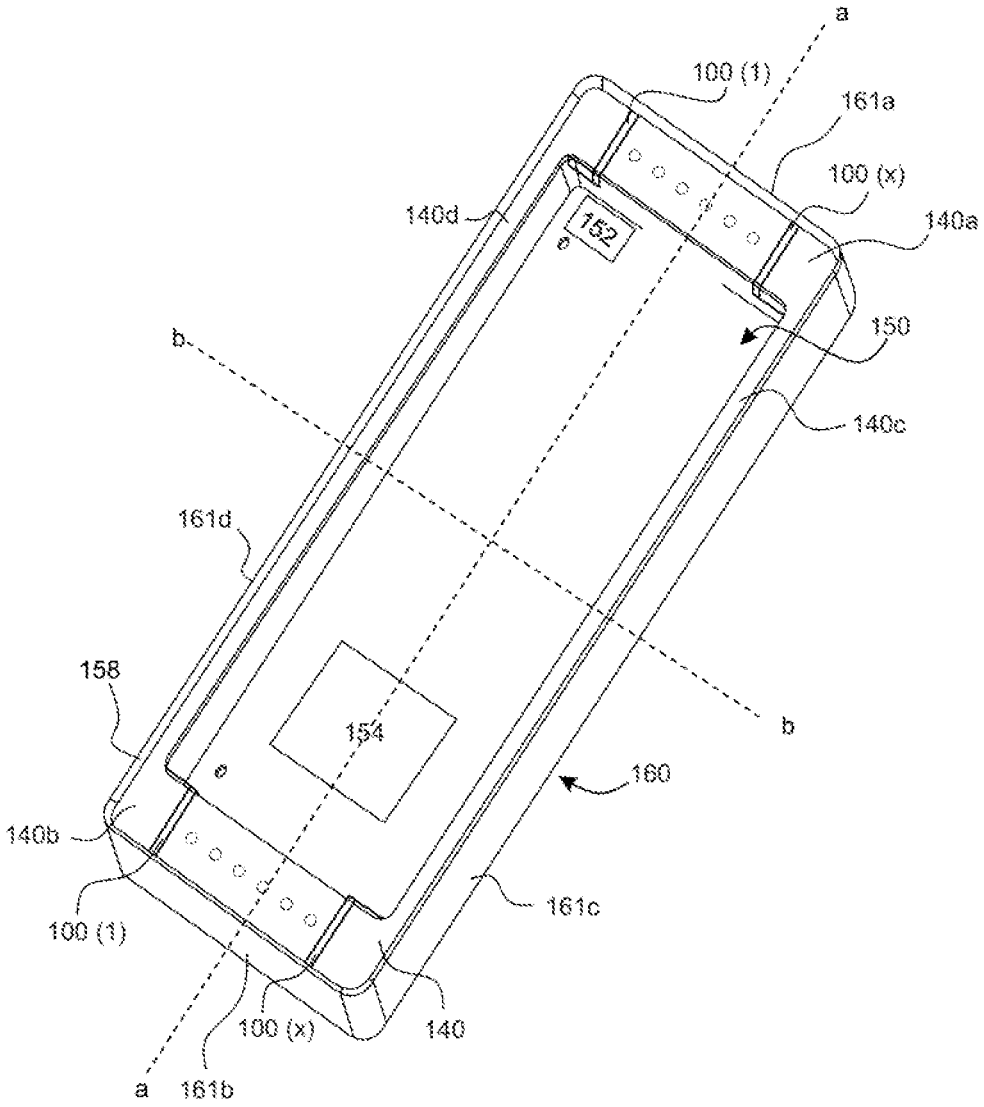
FIG. 9 is a back perspective view of an electronic device, according to a further arrangement of example embodiments.

The number of antennas 100 placed on the top portion **140*a* and the bottom portion 140*b* of the support member 140 may be varied. As illustrated in the example of FIG. 9, a plurality of the antennas 100(1)-100(*x*) are placed on each of the top portion 140*a* and the bottom portion 140*b* of the support member 140. X is an integer greater or equal to 1. For example, x may be 6 or 7. In this case, 6 or 7 antennas 100 may be placed on each of the top portion 140*a* and the bottom portion 140*b* of the support member 140** to form MIMO antenna systems more than 8 antennas, such as 12×12 or 14×14 MIMO antenna systems.

8×8 MIMO Antenna System—Antennas 200

Figure 10:
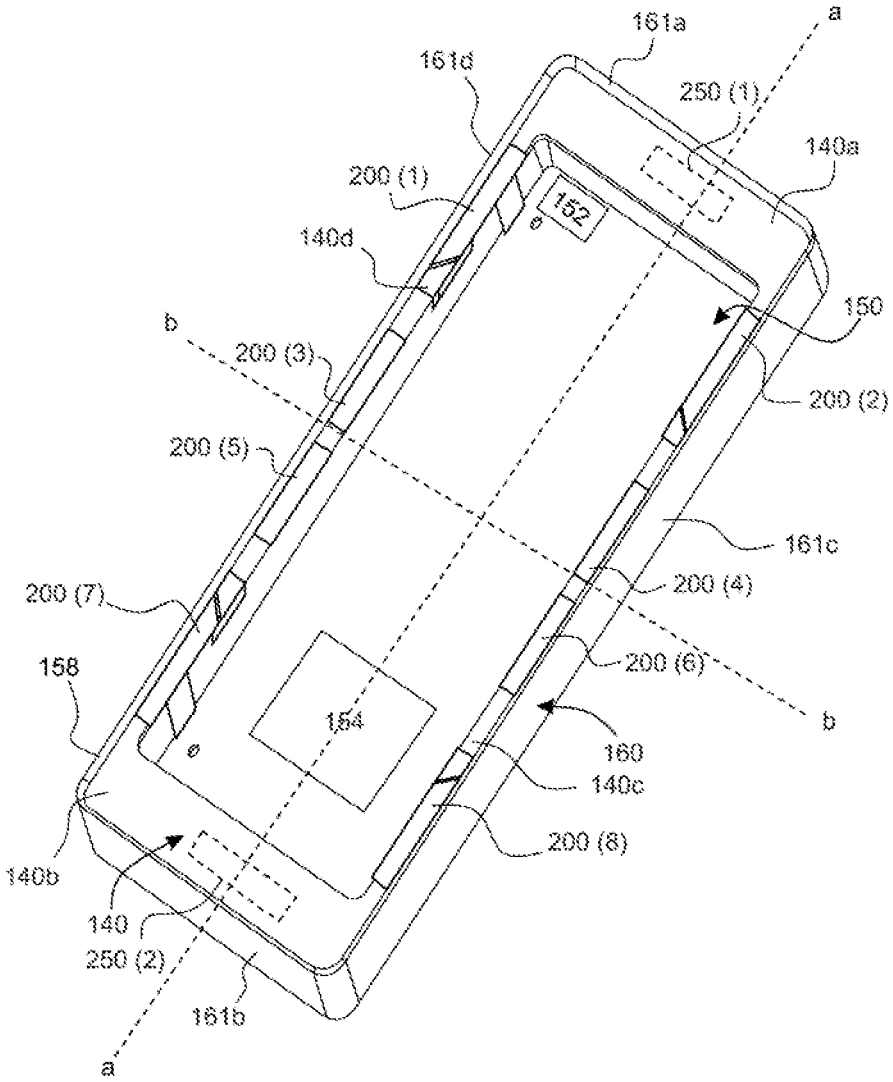
FIG. 10 is a back perspective view of an electronic device, according to a third arrangement of example embodiments.

FIG. 10 illustrates a further exemplary 8×8 MIMO antenna system which includes eight antennas 200 supported in housing 158. As shown in FIG. 10, 4 antennas 200(1), 200(3), 200(5) and 200(7) are securely placed on the back surface of the left side portion **140*d* of the support member 140, and 4 antennas 200(2), 200(4), 200(6) and 200(8) are securely placed on the back surface of the right side portion 140*c* of the support member 140, for example by copper glue. Each of the antennas 200(1)-200(8) are electrically connected to the transceiver 152 on the PCB board 150 in the manner discussed previously. Battery 154 supplies power to PCB 150 and transceiver 152**.

In some example embodiments, antennas 200(1), 200(3), 200(5) and 200(7) are substantially symmetrically with antennas 200(2), 200(4), 200(6) and 200(8), respectively, with respect to the longitude central axis a-a of the electronic device 10.

In some example embodiments, antennas 200(1) and 200(3) are substantially symmetrical with antennas 200(7) and 200(5), and antennas 200(2) and 200(4) are substantially symmetrical with antennas 200(8) and 200(6), respectively, with respect to the latitude central axis b-b of the electronic device 10.

In some example embodiments, the first radiating member 201 of the antennas 200 (1)-200(8) are pointed to the same direction, for example towards the top of electronic device 10.

In some example embodiments, the first radiating member 201 of antennas 200(1), 200(3), 200(5) and 200(7) on the left side portion 140*d* of the support member 140 and antennas 200(2), 200(4), 200(6) and 200(8) on the right side portion 140*d* of the support member 140 are pointed in opposite directions. For example, first radiating member 201 of the antennas 200(1), 200(3), 200(5) and 200(7) are pointed to the top of the electronic device 10, while first radiating member 201 of the antennas 200(2), 200(4), 200(6) and 200(8) are pointed to the bottom of electronic device 10.

Figure 11:
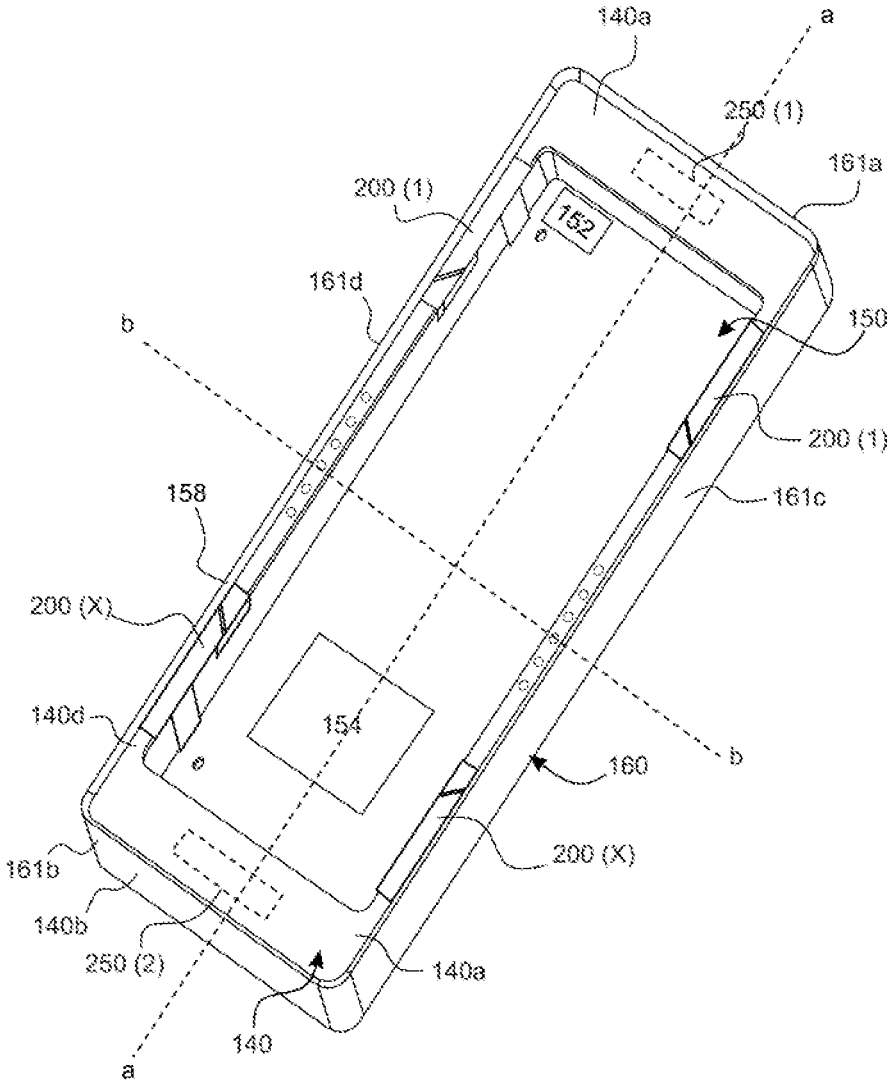
FIG. 11 is a back perspective view of an electronic device, according to still a further arrangement of example embodiments.

The number of antennas 200 placed on the side portions 140*c* and 140*d* of the support member 140 may be varied. As illustrated in the example of FIG. 11, a plurality of the antennas 200(1)-100(*x*) are placed on the each of two side portions 140*c* and 140*d* of the support member 140. X is an integer greater or equal to 1. For example, X is 6 or 7. In this case, 6 or 7 antennas 100 are placed on each of the side portions 140*c* and 140*d* of the support member 140 to form 12×12 or 14×14 MIMO antenna systems.

In examples described above, the antennas 100 and 200 secured to the housing 158 are all have a frequency range of 3 GHz-5 GHz, the antennas 100 are substantially identical to each other and the antennas 200 are substantially identical to each other.

In the example embodiments illustrated in FIGS. 1-3 and 8-11, the two radiating members 102 and 104 of all antennas 100 and two radiating members 201 and 202 of all antennas 200 are on planes that are substantially perpendicular to each other. The antennas 100 and 200 in these example embodiments are secured to the housing 158 in a three dimensional space.

In some embodiments, the two radiating members 102 and 104 of all antennas 100 and two radiating members 201 and 202 of all antennas 200 are on the same plane. In this case, the antennas 100 and 200 can be attached to a substantially two dimensional plane in the housing 158.

In some embodiments, the antenna can include a combination of antennas 100, 200 having perpendicular radiating members and co-planar radiation members.

Performance of Exemplary 8×8 MIMO Antenna Systems

In at least some configurations, the exemplary 8×8 MIMO antenna systems described above are compatible with previous 2G, 3G, 4G antenna technologies, and provide broad bandwidth from 3-5 GHz, high efficiency, low correlation and hybrid UE Wi-Fi antenna applications.

In some examples, 8×8 MIMO antenna systems such as those shown in FIG. 1 have a low correlation between different pairs of antennas 100 and 200. For example, according to measured simulation results, the Rx-Rx Envelope Correlation Coefficient between different pairs of antennas 100 and 200 is substantially below 0.1 from 3 GHz to 5 GHz. As well, the measured results indicated a measured mutual coupling between any two antennas 100 and 200 is below −10 dB from 3 GHz to 5 GHz. Because of the low correlation and low mutual coupling between different pairs of antennas, each of the antennas can function independently from the others and be closely placed in the housing frame 160 or on the support member 140, and this in turn maximizes wireless channel capacity represented by each of antennas 100 (1)-100(4) and 200 (1)-200(4).

The exemplary 8×8 MIMO antenna systems have high efficiency in some configurations. According to measured results, with the battery 154 included in electronic device 10, the 8×8 MIMO antenna systems have, in some simulations, a total efficiency above 55% in most the frequency range from 3 GHz to 5 GHz, above 60% at 3.5 GHz and 4.8 GHz, and above 60% at 2.4 GHz and 5.8 GHz Wi-Fi frequency spectrums and 2.4 GHz Bluetooth frequency range.

The 8×8 MIMO antenna system in the example of FIG. 1 can have a high data throughput. The measured channel capacity of the 8×8 MIMO antenna system in MIMO evaluation chamber is only 6% less than that of the ideal upper simulation bound.

As well, the 8×8 MIMO antenna systems also have a good impedance matching with the output impedance of the transceiver 152 of the electronic device 10 at the frequency range of 3 GHz to 5 GHz. According to measured results, the 8×8 MIMO antenna systems have scattering parameters $S_{Rx\text{-}Rx}$ equal or substantially less than −10 dB from 3 GHz to 5 GHz.

In addition, the 8×8 MIMO antenna system in the example of FIG. 1 can have high effective diversity gain and apparent diversity gain. For example, the measured effective diversity gain for a simulation of the 8×8 MIMO antenna system in the example of FIG. 1 is above 14 dB from 3 GHz to GHz at 0.01 cumulative distribution function (CDF) level, and the measured apparent diversity gain is above 17 dB from 3 GHz to 5 GHz at 0.01 CDF level.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

The invention claimed is:

1. A multiple input multiple output (MIMO) antenna array comprising:

a plurality of antenna pairs for transmitting RF signals from a transmitter of an electronic device and for receiving external RF signals, each antenna pair including a first antenna and a second antenna;

the first antenna including a first radiating member and a second radiating member that are disposed on two planes orthogonal with respect to each other, wherein the first radiating member and the second radiating member are configured to be placed on two respective orthogonal surfaces of a supporting member of the electronic device;

the second antenna including a third radiating member and a fourth radiating member that are disposed on two planes orthogonal with respect to each other, wherein the third radiating member and the fourth radiating member are configured to be placed on the two respective orthogonal surfaces of the supporting member, wherein the first antenna has a physical configuration different from that of the second antenna, and the first antenna and second antenna are configured to operate in an identical frequency range, and the plurality of antenna pairs are arranged symmetrically both with respect to a longitudinal central axis and a latitudinal central axis of a housing of the electronic device.

2. The MIMO antenna array of claim 1, wherein the identical frequency range includes, for each of the antennas, a first frequency range and a second frequency range, wherein the first frequency range is 4-5 GHz and the second frequency range is 3-4 GHz.

3. The MIMO antenna array of claim 1, wherein the housing has four corners and the MIMO array includes four of the antenna pairs, each antenna pair being located at a respective corner of the housing.

4. The MIMO antenna array of claim 3 wherein the first antenna and second antenna in each antenna pair are arranged at the respective corners so that any RF mutual coupling therebetween will not exceed a maximum threshold of −10 dB from 3 GHz to 5 GHz.

5. The MIMO antenna array of claim 4 wherein the antenna pairs are arranged so that the Rx-Rx Envelope Correlation Coefficient between the antenna pairs is below 0.1 from 3 GHz to 5 GHz.

6. The MIMO antenna array of claim 1 wherein, for each first antenna, the first radiating member and the second radiating member are substantially planar and rectangular, a first end of the first radiating member being connected to a side edge of the second radiating member.

7. The MIMO antenna array of claim 6 wherein a major axis of the first radiating member extends in a direction that is perpendicular to a major axis of the second radiating member.

8. The MIMO antenna array of claim 1 wherein for each second antenna the third radiating member and the fourth radiating member are substantially planar and rectangular, a side edge of the third radiating member being connected to a side edge of the fourth radiating member by a connecting member.

9. The MIMO antenna array of claim 8 wherein the third radiating member includes a slot, a first resonating body, and a second resonating body, wherein the first resonating body and the second resonating body are separated by the slot, the first resonating body being connected through the connecting member and the fourth radiating member to an RF feed point, the second resonating body being connected to a grounding element.

10. The MIMO antenna array of claim 1 wherein the second antenna is configured to operate in a 2.4 GHz and 5.8 Ghz frequency band in addition to the identical frequency range.

11. The MIMO antenna array of claim 1 wherein the MIMO antenna array is included in the electronic device, the electronic device further comprising a radio frequency (RF) communication circuit, the plurality of antennas connected to the RF communication circuit.

12. The MIMO antenna array of claim 11 wherein the electronic device is a handheld device having a display screen.

13. The MIMO antenna array of claim 11 wherein the electronic device has a battery.

14. The MIMO antenna array of claim 1 wherein the first radiating member and the second radiating member function as monopole antennas.

15. The MIMO antenna array of claim 1 wherein the third radiating member functions as a Planar Inverted F (PIFA) antenna, and the fourth radiating member functions as a monopole antenna.

* * * * *